US006452495B2

(12) United States Patent
Choi

(10) Patent No.: US 6,452,495 B2
(45) Date of Patent: Sep. 17, 2002

(54) SECURITY BARBED WIRE

(76) Inventor: Sang J. Choi, 2425 W. 183rd St., Apt. #A, Homwood, IL (US) 60430

( * ) Notice: Subject to any disclaimer, the term of this patent is extended or adjusted under 35 U.S.C. 154(b) by 0 days.

(21) Appl. No.: 09/842,423

(22) Filed: Apr. 27, 2001

(51) Int. Cl.[7] ..... G08B 13/00

(52) U.S. Cl. ..... 340/550; 340/551; 340/450; 340/451; 340/664; 340/668; 174/74 A; 174/75 C; 174/78; 174/88 C; 174/256

(58) Field of Search ..... 340/550, 551, 340/450, 451, 664, 668; 174/74 A, 75 C, 78, 88 C, 256

(56) References Cited

U.S. PATENT DOCUMENTS 4,196,890 A * 4/1980 Einhorn ..... 256/2
4,579,317 A * 4/1986 Foissner et al. ..... 256/10
5,461,364 A * 10/1995 Sanford et al. ..... 340/541
5,852,402 A * 12/1998 Perry ..... 340/541

* cited by examiner

*Primary Examiner*—Jeffery Hofsass
*Assistant Examiner*—Tai T. Nguyen

(57) ABSTRACT

This invention is relating to a barbed wire, of which one strand is a conventional iron wire, and the other strand is a conductor embedded plastic wire that includes a conductor covered by a sturdy plastic insulator. The purpose of using a conductor embedded plastic wire is that it can be used for an alarm system where high security is demanded. This invention provides easier manufacturing process and simpler method for the application of the barbed wire to an alarm system than the products of prior art of U.S. Pat. No. 4,317,955. Therefore, this invention is less expensive to produce the product.

2 Claims, 1 Drawing Sheet

SECURITY BARBED WIRE

FEDERALLY SPONSORED RESEARCH OR DEVELOPMENT

Not applicable.

MICROFICHE APPENDIX

Not appendix.

BACKGROUND OF THE INVENTION

With the installation of a barbed wire of prior art, in the most cases, the objectives can be achieved by deterring any intrusion. However, where high security is demanded, in addition to the normal barbed wire installation, an alarm system can be installed, which can be triggered whenever an intruder cuts the barbed wire.

In another prior invention of U.S. Pat. No. 4,317,955, epoxy insulated conductor wire is inserted into a groove inside the regular iron wire, which is coated by zinc layer. The said prior art requires two wires, copper wire and iron wire, for each strand of the barbed wire, in contrast to the present invention, which requires only one wire per strand. With the prior art, the manufacturing process is much complicated and applying the conductor to an alarm system is very difficult because peeling off the outer iron layer is not easy. In said prior art, the iron and copper wires are zinc coated. During the processing of the barb application, there is considerable risk of zinc coating and epoxy insulation layers being damaged due to the high pressure applied to form the barb causing the barbed wire unable to apply to an alarm system.

SUMMARY OF THE INVENTION

This invention pertains to a barbed wire system, which includes a strand of plastic wire, of which a thin conductor wire is embedded internally, to be used in an alarm system. Whenever an intruder cuts the barbed wire, it will cut the conductor embedded plastic wire too. This action will trigger the alarm system. This invention provides an improved security system than the conventional barbed wire only installation.

This invention also provides easier manufacturing process for said barbed wire by using a strand of conductor embedded plastic wire that is the distinctive part of this invention, renders simpler application of the barbed wire to an alarm system, and causes less susceptible to the damage on the insulation layer than the prior art, U.S. Pat. No. 4,317,955, composed of a conductor insulated by epoxy enamel and inserted into the groove of an iron wire, which is covered by zinc layer. These different features of two inventions, said present invention and said prior art, are distinctively illustrated in the figures of the both inventions.

DETAILED DESCRIPTION OF THE INVENTION

Figure 1:
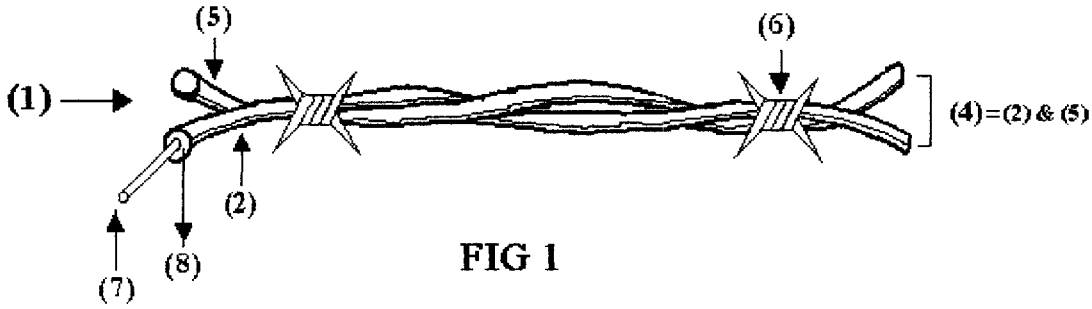
FIG. 1 is a pictorial view of a segment of the barbed wire of this invention. It shows that all the components of said barbed wire.

As shown in FIG. 1, a barbed wire (1) comprises a conventional iron wire (5), a conductor embedded plastic wire (2) that is the distinctive part of this invention, and many barbs (6). The iron wire (5) and the conductor embedded plastic wire (2) are twisted together longitudinally to form a barb carrying wire (4). The barbs (6) are wound around to encircle the barb carrying wire (4) producing the security barbed wire for this invention (1).

The conductor embedded plastic wire (2) comprises a conductor wire (7) and a plastic insulating layer (8). The barbed wire (1) looks as an ordinary conventional barbed wire in external view, and the conductor embedded plastic wire (2) looks as an ordinary conventional house electrical wire. The thickness of the conductor (7) does not have to be very thick, because the conductor carries very little current, however, it should be thick and strong enough not to be broken during the manufacturing and installation processes.

The structure of the plastic layer (8) should be strong and sturdy enough to be sustained as a ordinary barbed wire and flexible enough to be twisted as a barbed wire. The diameter of the plastic layer should be the same as that of the iron wire (5). The color of the plastic cover should conspicuously be the same as that of the other strand of iron wire (5).

The manufacturing process of the security barbed wire (1) is the same as that of barbed wires of prior art except using a conductor embedded plastic wire (2) for one strand.

Therefore, this invention provides much easier and simpler manufacturing process than prior art, U.S. Pat. No. 4,317,955. This invention also facilitates the connection of two pieces together during the barbed wire installation because it is much easier to peel off the ends of the conductor embedded plastic wire just like regular house electrical wire connections.

Figure 2:
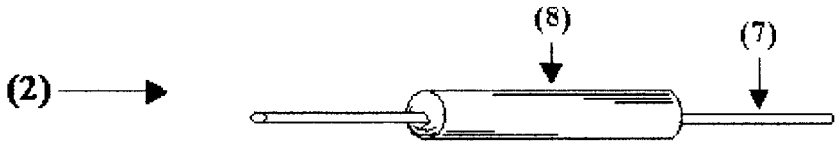
FIG. 2 is a sectional view of a conductor embedded plastic wire, which is a distinctive element used as part of said barbed wire.

FIG. 2 is an enlarged drawing of conductor embedded plastic wire (2) of FIG. 1. The conductor embedded plastic wire (2) is consisted of a thin conductor wire (7) embedded in the plastic wire (8) that also provides the sturdiness to be used as part of the security barbed wire.

The manufacturing process of the conductor embedded plastic wire (2) is the same as that of a conventional house electrical wire of prior arts except that the conductor (7) is much thinner in diameter than the conductor of normal electrical wire and the diameter of the plastic layer (8) is the same size of the iron strand (5).

Figure 3:
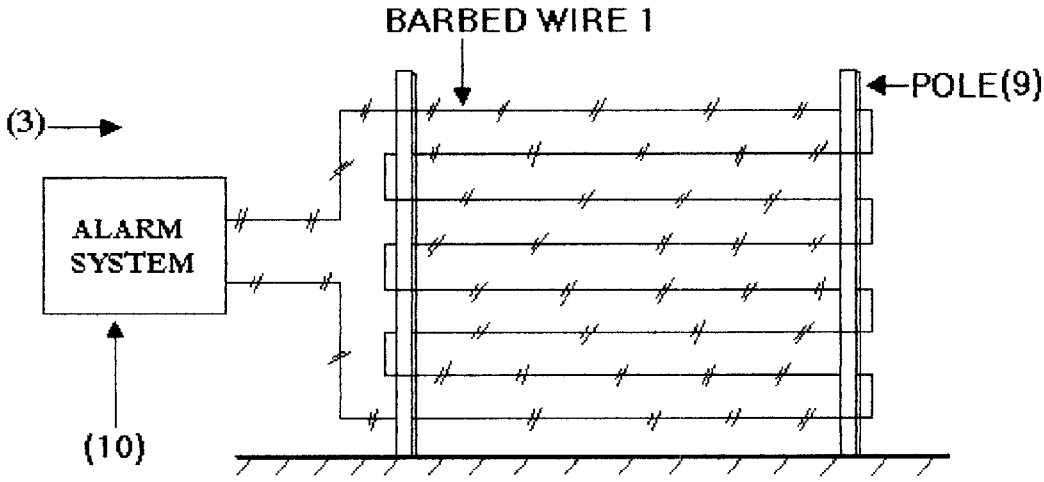
FIG. 3 is a diagram showing how said barbed wire is used in conjunction with an alarm system.

FIG. 3 shows the method how this security barbed wire can be utilized in conjunction with an alarm system. Except the connection to an alarm system, the installation of the security barbed wire to a fence application would be the same as the ordinary barbed wire installation. The whole length of barbed wire (1) is serially connected to an alarm system (10) by providing the continuity for the loop of the barbed wire (1). The pole (9) supports the barbed wire (1) fastened to it and maintains the necessary tension.

What is claimed is:

1. A barbed wire construction comprising:

a single iron wire and a single conductor embedded plastic wire, wherein said single conductor embedded plastic wire is the distinctive part for said barbed wire and made of by centrally embedding a thin copper conductor wire through a thick and sturdy plastic wire, said single iron wire and said single conductor embedded plastic wire are twisted together longitudinally to form a barb carrying wire, and plurality of the barbs wound around to encircle the barb carrying wire.

2. A barbed wire construction defined in claim 1, wherein said single conductor embedded plastic wire comprising:

a thin copper conductor wire, for providing continuity for an alarm system, and a thick and sturdy plastic layer covering the conductor wire for rendering physical strength of the barb carrying wire not to be broken when installed on a fence, and providing insulation for the conductor wire to prevent it from shortening out with the other iron strand.

* * * * *